US011014263B2

(12) United States Patent
Sarius et al.

(10) Patent No.: US 11,014,263 B2
(45) Date of Patent: May 25, 2021

(54) CHAINSAW CHAIN AND/OR BAR WITH COATINGS HAVING SPECIFIC PROPERTIES

(71) Applicant: HUSQVARNA AB, Huskvarna (SE)

(72) Inventors: Niklas Sarius, Jönköping (SE); Adam Ståhlkrantz, Stockholm (SE)

(73) Assignee: HUSQVARNA AB, Huskvarna (SE)

( * ) Notice: Subject to any disclaimer, the term of this patent is extended or adjusted under 35 U.S.C. 154(b) by 62 days.

(21) Appl. No.: 15/784,701

(22) Filed: Oct. 16, 2017

(65) Prior Publication Data

US 2018/0065271 A1 Mar. 8, 2018

(30) Foreign Application Priority Data

Sep. 6, 2016 (SE) ..... 1651194-1

(51) Int. Cl.

*B27B 33/14* (2006.01)
*B27B 17/02* (2006.01)
*B27B 17/12* (2006.01)

(52) U.S. Cl.

CPC ..... *B27B 33/142* (2013.01); *B27B 17/02* (2013.01); *B27B 17/025* (2013.01); *B27B 17/12* (2013.01); *B27B 33/14* (2013.01)

(58) Field of Classification Search

CPC ..... B27B 17/02; B27B 17/025; B27B 33/14; B27B 33/142; B27B 33/144; B27B 17/12

See application file for complete search history.

(56) References Cited

U.S. PATENT DOCUMENTS 3,308,859 A 3/1967 Ehlen
3,469,610 A 9/1969 Silvon
3,755,866 A 9/1973 Ohlsson
3,900,592 A * 8/1975 Kennedy ..... C23C 14/0021 427/249.19

(Continued)

FOREIGN PATENT DOCUMENTS

CA 1198343 A * 12/1985 ..... B27B 33/142
CA 1198343 A 12/1985

(Continued)

OTHER PUBLICATIONS

English Translation of FR2519896 (Year: 1983).*

(Continued)

*Primary Examiner* — Jennifer B Swinney
(74) *Attorney, Agent, or Firm* — Burr & Forman, LLP

(57) ABSTRACT

A cutting chain for a chainsaw may include a plurality of drive links, and a plurality of cutter links. Each of the drive links includes a top portion and a bottom portion that interfaces with a guide bar of the chainsaw. The cutter links are operably coupled to respective ones of the drive links at the top portion thereof. At least one of the cutter links includes a base portion and a cutting portion extending away from the base portion. The cutting portion includes a side plate and a top plate, the top plate including a top face and a bottom face. The side plate includes an outer face and an inside face. Multiple coating materials are provided on respective different surfaces of the drive links or cutter links such that different coating materials are applied based on a wear context of the respective different surfaces.

13 Claims, 7 Drawing Sheets

(56) References Cited

U.S. PATENT DOCUMENTS

| | | | | |
|---|---|---|---|---|
| 4,554,853 | A | 11/1985 | Nitschmann et al. | |
| 4,768,289 | A * | 9/1988 | Apfel | B23K 35/3046 30/383 |
| 4,924,577 | A * | 5/1990 | Leini | B27B 17/025 30/383 |
| 5,165,318 | A * | 11/1992 | Wesley | B23D 63/162 83/834 |
| 5,215,072 | A | 6/1993 | Scott | |
| 5,471,751 | A | 12/1995 | Ball | |
| 6,944,957 | B2 | 9/2005 | Donnerdal et al. | |
| 7,900,536 | B2 | 3/2011 | Hensley et al. | |
| 8,863,629 | B2 | 1/2014 | Yancey et al. | |
| 8,651,005 | B2 | 2/2014 | Yancey et al. | |
| 2004/0182216 | A1 | 9/2004 | Morrison | |
| 2009/0217537 | A1 | 9/2009 | Macdonald et al. | |
| 2010/0005666 | A1 | 1/2010 | Seigneur et al. | |
| 2010/0005668 | A1 | 1/2010 | Yancey et al. | |
| 2014/0090532 | A1 | 4/2014 | Goettel | |
| 2015/0013173 | A1 | 1/2015 | Hug et al. | |
| 2015/0231793 | A1* | 8/2015 | Engelfried | B27B 33/141 30/383 |
| 2019/0077715 | A1* | 3/2019 | Alessi | C04B 22/066 |

FOREIGN PATENT DOCUMENTS

| | | | | |
|---|---|---|---|---|
| CN | 85201006 | U | 1/1986 | |
| CN | 85107323 | A | 10/1986 | |
| CN | 2041241 | U | 7/1989 | |
| CN | 1622871 | A | 6/2005 | |
| CN | 101460282 | A | 6/2009 | |
| CN | 103402718 | A | 11/2013 | |
| DE | 830247 | C | 2/1952 | |
| DE | 30 17 519 | A1 | 11/1980 | |
| DE | 3002138 | A1 | 7/1981 | |
| DE | 10 2010 011837 | A1 | 9/2011 | |
| EP | 306767 | A * | 3/1989 | |
| EP | 0306767 | A1 | 3/1989 | |
| FR | 2519896 | A1 * | 7/1983 | B27B 33/142 |
| FR | 2519896 | A1 | 7/1983 | |
| GB | 1140469 | A | 1/1969 | |
| GB | 2131728 | A | 6/1984 | |
| WO | 2008008900 | A2 | 1/2008 | |
| WO | 2012143419 | A1 | 10/2012 | |

OTHER PUBLICATIONS

International Search Report and Written Opinion for International Application No. PCT/IB2016/051183 dated May 31, 2016.

International Search Report and Written Opinion for International Application No. PCT/IB2016/051201 dated May 31, 2016.

International Preliminary Report on Patentability for International Application No. PCT/IB2016/051183 dated Sep. 5, 2017.

International Preliminary Report on Patentability for International Application No. PCT/IB2016/051201 dated Sep. 5, 2017.

* cited by examiner

CHAINSAW CHAIN AND/OR BAR WITH COATINGS HAVING SPECIFIC PROPERTIES

TECHNICAL FIELD

Example embodiments generally relate to hand held power equipment and, more particularly, relate to cutting chain and bar improvements for a chainsaw.

BACKGROUND

Chainsaws are commonly used in both commercial and private settings to cut timber or perform other rigorous cutting operations. Because chainsaws are typically employed in outdoor environments, and the work they are employed to perform often inherently generates debris, chainsaws are typically relatively robust hand held machines. Chainsaws can be powered by gasoline engines or electric motors (e.g., via batteries or wired connections) to turn a chain around a guide bar at relatively high speeds. The chain includes cutting teeth that engage lumber or another medium in order to cut the medium as the teeth are passed over a surface of the medium at high speed.

Given that the chainsaw may be employed to cut media of various sizes and types, it should be appreciated that the design of the chain itself may have an impact on the effectiveness of the cutting operations. In particular, cutter edges of the chain may wear over time. This wear occurs based on the edges being grinded or abraded by the material that the chain is cutting, or that is encountered while the chain is cutting. For softer materials, such as wood, this wearing process may be relatively slow. However, even wood may have hardness variations at various different parts of the wood. For example, the bark may be exposed to other materials (e.g., sand, ash, dirt, etc.). Thus, if the bark has some of these particles embedded therein (e.g., by the wind or other natural forces), the wearing process may be accelerated when the chain is engaged in cutting of the bark.

Wear may also be experienced between portions of the cutting chain that contact each other, and between the bar and portions of the cutting chain that contact the bar. As such, it may be desirable to explore a number of different bar and chain design improvements that could be employed alone or together with other design changes to improve overall chainsaw, and cutting chain, performance. In particular, it may be desirable to improve the wear resistance of the cutting chain and portions thereof that interact with the bar or other portions of the cutting chain and material being cut.

BRIEF SUMMARY OF SOME EXAMPLES

Some example embodiments may provide for a chainsaw chain and/or bar constructed with modifications to portions thereof that may otherwise experience wear over time in order to improve wear properties. The modification to the links of the chain may improve cutting efficiency and minimize the energy required for executing the cutting procedure, and/or minimize wear. The bar modifications may reduce wear and reduce the need for oil application to the chain. The modifications may involve applying one or more coatings to various specific locations on the cutting chain and/or bar. As such, specific portions of the cutter links, drive links, or any other portions of the cutting chain and/or bar that have unique wear context considerations can be addressed with coatings that are appropriate for the respective wear contexts. The cutter links may therefore have better stay sharp properties and a longer useful life, and the bar may wear less and cause less wear on the chain as well as allowing reduced (or no) dependency on oil for wear minimization. Other improvements may also be possible, and the improvements can be made completely independent of each other, or in combination with each other in any desirable configuration. Accordingly, the operability and utility of the chainsaw may be enhanced or otherwise facilitated.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
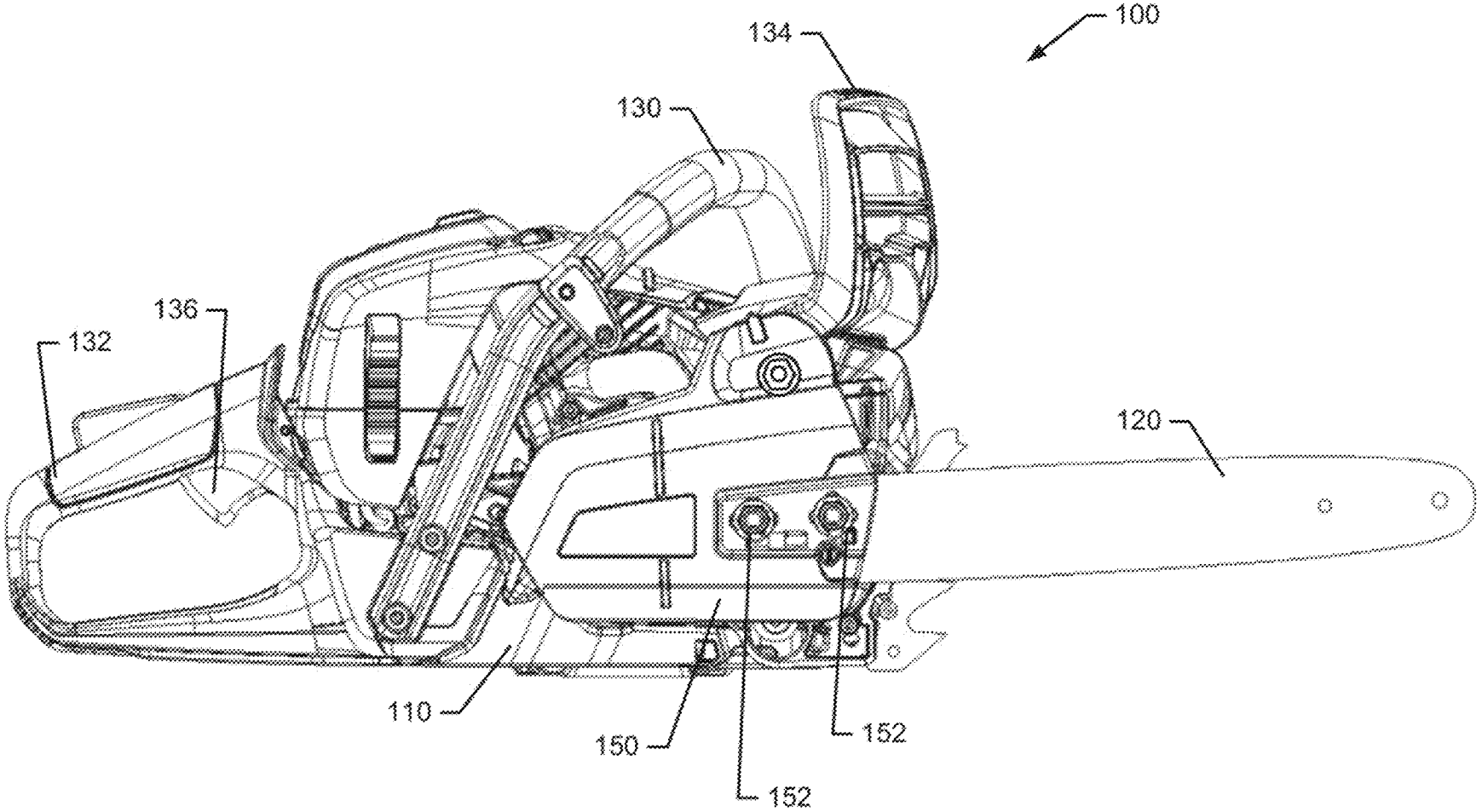
FIG. 1 illustrates a side view of a chainsaw according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

FIG. 1 illustrates side view of a chainsaw 100 according to an example embodiment. As shown in FIG. 1, the chainsaw 100 may include a housing 110 inside which a power unit or motor (not shown) is housed. In some embodiments, the power unit may be either an electric motor or an internal combustion engine. Furthermore, in some embodiments, the power unit may include more than one electric motor where one such electric motor powers the working assembly of the chainsaw 100 and the other electric motor of the power unit powers a pump that lubricates the working assembly or provides momentum for moving other working fluids within the chainsaw 100. The chainsaw 100 may further include a guide bar 120 that is attached to the housing 110 along one side thereof. A chain (not shown) may be driven around the guide bar 120 responsive to operation of the power unit in order to enable the chainsaw 100 to cut lumber or other materials. The guide bar 120 and the chain may form the working assembly of the chainsaw 100. As such, the power unit may be operably coupled to the working assembly to turn the chain around the guide bar 120.

The chainsaw 100 may include a front handle 130 and a rear handle 132. A chain brake and front hand guard 134 may be positioned forward of the front handle 130 to stop the movement of the chain 122 in the event of a kickback. In an example embodiment, the hand guard 134 may be tripped by rotating forward in response to contact with a portion of the arm (e.g., the hand/wrist) of the operator of the chainsaw 100. In some cases, the hand guard 134 may also be tripped in response to detection of inertial measurements indicative of a kickback.

The rear handle 132 may include a trigger 136 to facilitate operation of the power unit when the trigger 136 is actuated. In this regard, for example, when the trigger 136 is actuated (e.g., depressed), the rotating forces generated by the power unit may be coupled to the chain either directly (e.g., for electric motors) or indirectly (e.g., for gasoline engines). The term "trigger," as used herein, should be understood to represent any actuator that is capable of being operated by a hand or finger of the user. Thus, the trigger 136 may represent a button, switch, or other such component that can be actuated by a hand or portion thereof.

Some power units may employ a clutch to provide operable coupling of the power unit to a sprocket that turns the chain. In some cases (e.g., for a gasoline engine), if the trigger 136 is released, the engine may idle and application of power from the power unit to turn the chain may be stopped. In other cases (e.g., for electric motors), releasing the trigger 136 may secure operation of the power unit. The housing 110 may include a fuel tank for providing fuel to the power unit. The housing 110 may also include or at least partially define an oil reservoir, access to which may be provided to allow the operator to pour oil into the oil reservoir. The oil in the oil reservoir may be used to lubricate the chain as the chain is turned.

As can be appreciated from the description above, actuation of the trigger 136 may initiate movement of the chain around the guide bar 120. A clutch cover 150 may be provided to secure the guide bar 120 to the housing 110 and cover over the clutch and corresponding components that couple the power unit to the chain (e.g., the sprocket and clutch drum). As shown in FIG. 1, the clutch cover 150 may be attached to the body of the chainsaw 100 (e.g., the housing 110) via nuts 152 that may be attached to studs that pass through a portion of the guide bar 120. The guide bar 120 may also be secured with the tightening of the nuts 152, and a tightness of the chain can be adjusted based on movement of the guide bar 120 and subsequent tightening of the nuts 152 when the desired chain tightness is achieved. However, other mechanisms for attachment of the clutch cover 150 and/or the guide bar 120 may be provided in other embodiments including, for example, some tightening mechanisms that may combine to tighten the chain in connection with clamping the guide bar 120.

Figure 2:
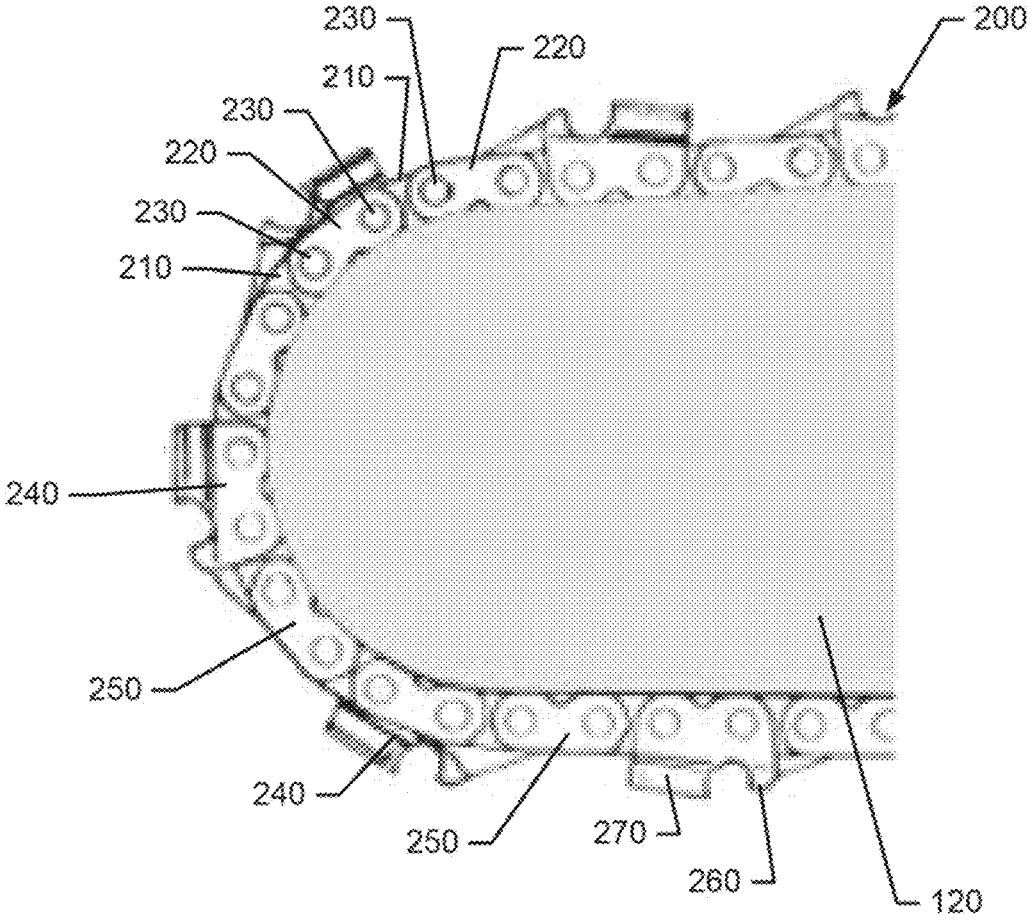
FIG. 2 illustrates a side view of a chainsaw guide bar employing a chain according to an example embodiment.

In some embodiments, the guide bar 120 may be formed from two laminate core sheets that lie in parallel planes alongside each other to define a channel around a periphery of the guide bar 120. The chain (or at least a portion of the chain) may ride in the channel, as the rest of the chain rides along the periphery of the guide bar 120 to engage media for cutting. FIG. 2 illustrates a typical chain 200 disposed on the guide bar 120. The chain 200 includes a plurality of center drive links 210 that each include a portion thereof that rides in the channel. Each center drive link 210 is attached to an adjacent pair of side links 220 by rivets 230 that extend perpendicular to the longitudinal length of the links. A rivet 230 is provided at the front portion of each center drive link 210 to attach the center drive link 210 to the rear portion of a preceding side links 220 and another rivet 230 is provided at the rear portion of each center drive link 210 to attach the center drive link 210 to the front portion of a subsequent side links 220. As such, each pair of side links 220 connects to opposing sides of the center drive links 210, and the connections are repeated in alternating fashion to complete a circular or endless chain.

For some pairs of side links 220 of the chain 200 one of the side links may be formed as a cutter link 240. Meanwhile, pairs of side links that do not include a cutter link 240 may be referred to as tie links 250. The cutter links 240 may be provided with two portions including a depth gauge portion 260 and a cutting portion 270. The cutting portion 270 may generally engage material that extends beyond the depth of the depth gauge portion 260 when the chain 200 is rotated. Meanwhile, the tie links 250 may not include cutting portions or depth gauge portions and may be provided to simply extend the length of the chain 200 while providing a space between portions of the chain 200 that will create cutting friction during cutting operations. If every side link 210 was a cutter link 240, the cutting friction on the chain 200 would be very high, and it would be difficult to provide sufficient power to turn the chain, and control of the chainsaw 100 could also become difficult.

Figure 3:
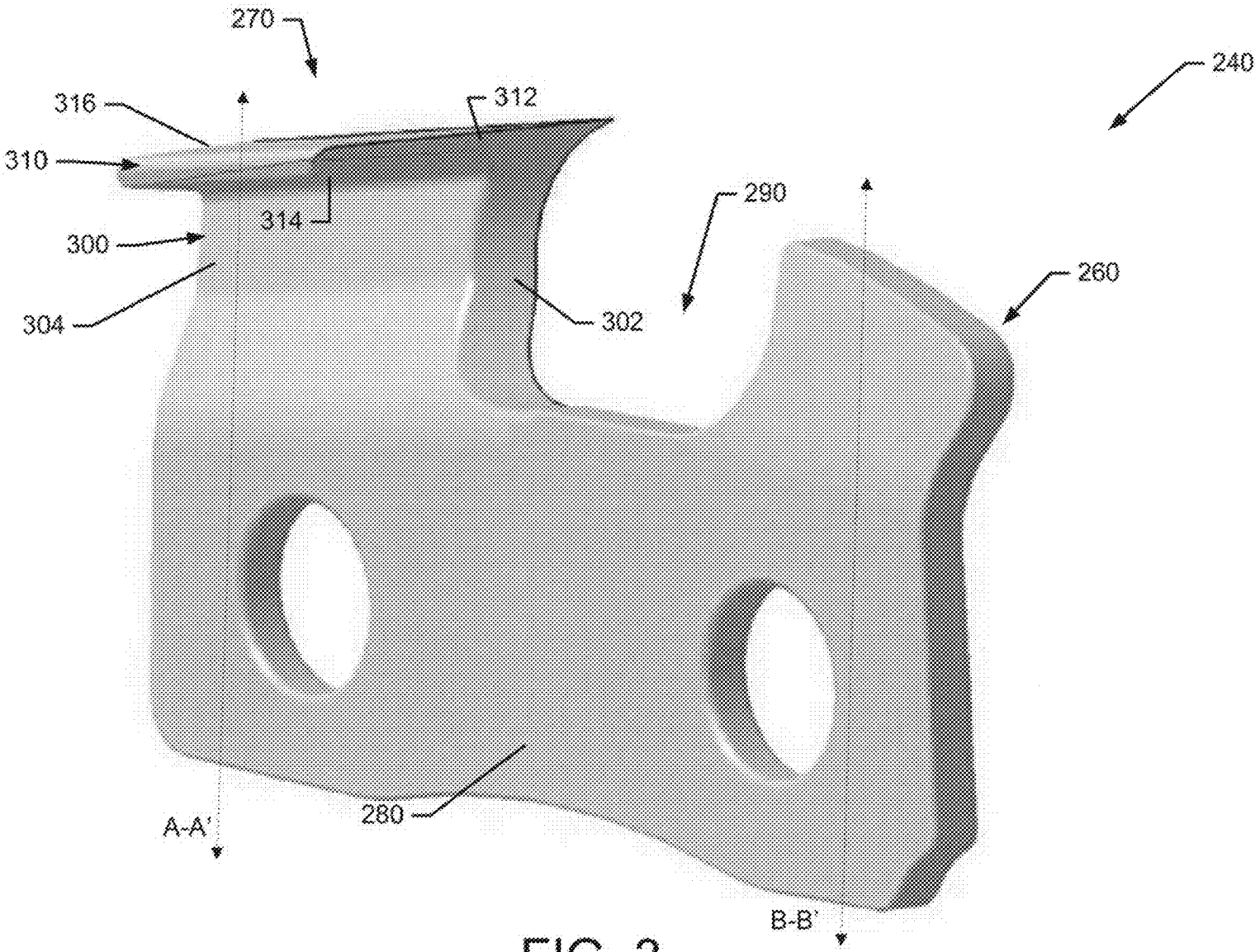
FIG. 3 illustrates a perspective side view of one cutter link in accordance with an example embodiment.
Figure 4:
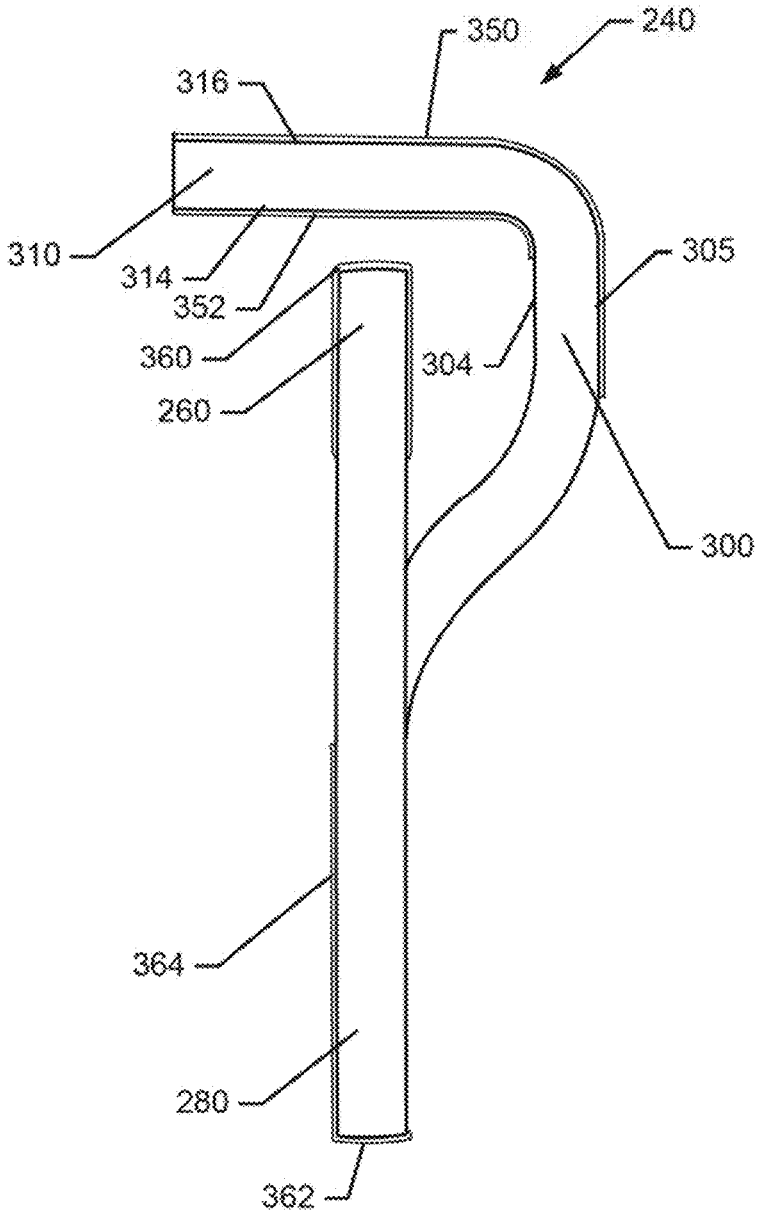
FIG. 4 illustrates a front view of a cutter link having a coating provided thereon in accordance with an example embodiment.

As shown in FIGS. 3 and 4, the cutter links 240 may have a base portion 280 from which both the cutting portion 270 and the depth gauge portion 260 extend. The rivets may be passed through holes in the base portion 280. Side links 220 that are not cutter links 240 may essentially only include the base portion 280, with corresponding holes for receiving the rivets. For cutter links 240, the cutting portion 270 may extend away from the base portion 280 in the same direction that the depth gauge portion 260 extends away from the base portion 280. However, the depth gauge portion 260 may be at one end of the cutter link 240 and the cutting portion 270 may be at the other end, separated from each other by a gap 290. Of note, the gap 290 may grow in size over time, as the cutting portion 270 is worn or abraded away due to use.

The cutting portion 270 may include a side plate 300 that extends upward away from the base portion 280. Although the side plate 300 generally extends in a direction parallel to plane in which the base portion 280 lies, the side plate 300 does not necessarily also lie in the same plane. In some cases, the side plate 300 may have a curved shape to bend slightly out of the plane in which the base portion 280 lies. Moreover, in some embodiments, the side plate 300 may bend out of the plane and then back toward the plane as it extends away from the base portion 280. Regardless, the distal end of the side plate 300 may be joined with a top plate 310. The top plate 310 may lie in a plane that is substantially perpendicular to the plane in which the base portion 280 lies.

The side plate 300 may have a leading edge 302 and an inside face 304. The side plate 300 may also have an outside face 305 (see FIG. 4) that is opposite the inside face 304, and a trailing edge that is opposite the leading edge 302. The top plate 310 may have a leading edge 312 that extends substantially perpendicular to the direction of extension of the base 280 (and in some cases also the direction of extension of the leading edge 302 of the side plate 300). The top plate 310 may also have a bottom face 314 and a top face 316. The top face 316 may be opposite the bottom face 314 and, in some cases, the top and bottom faces 316 and 314 may be in parallel planes. However, in some cases, the top and bottom faces 316 and 314 may be angled slightly toward each other as they extend away from the side plate 300. The top plate 310 may also have a trailing edge disposed opposite the leading edge 312.

In an example embodiment, the cutter link 240 may be formed by stamping, grinding and combinations thereof with or without other techniques also being employed. To execute a modification of the cutter link 240 in accordance with an example embodiment, the cutter link 240 may be treated after its initial formation in order to apply a coating material onto portions of the cutter link 240. In particular, specific coatings may be provided for corresponding different portions dependent upon the wear context for the corresponding portions. For example, the wear context for the top plate 310 is such that the top plate 310 (or at least certain portions thereof) encounters wear action by virtue of its interface with the material being cut. This may mean that a harder coating is suitable to slow or reduce the wear of the top plate 310.

Figure 5:
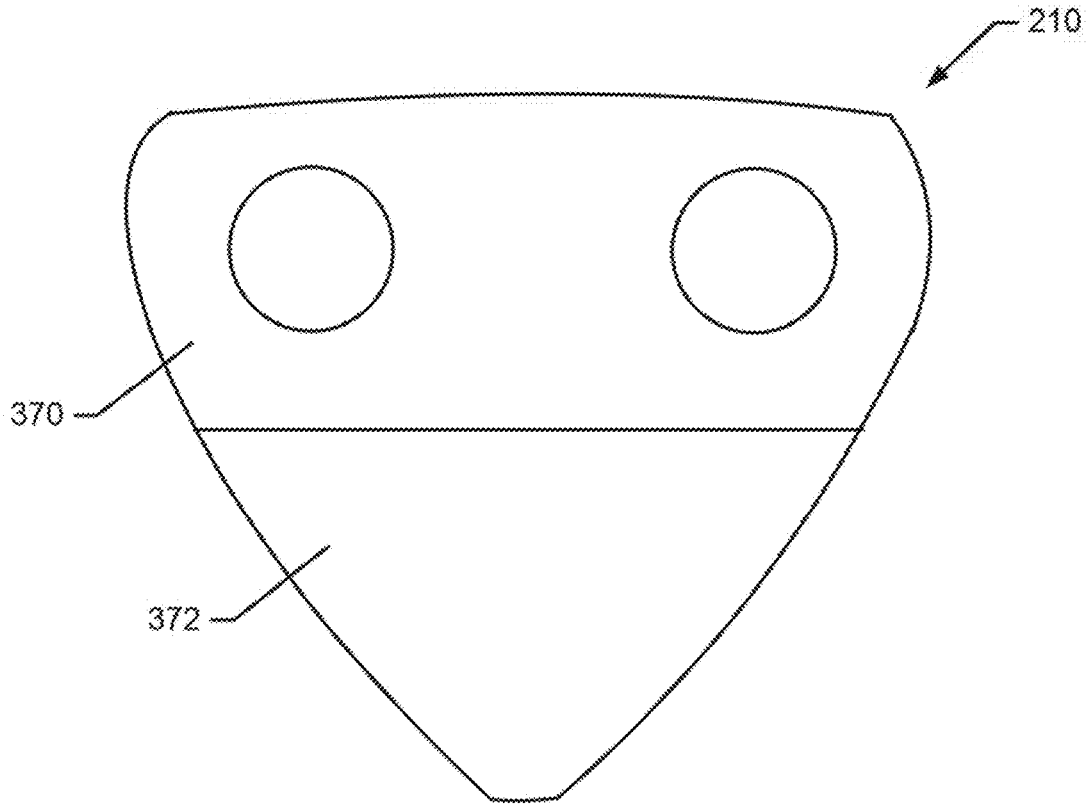
FIG. 5 illustrates a side view of a center drive link according to an example embodiment.
Figure 6:
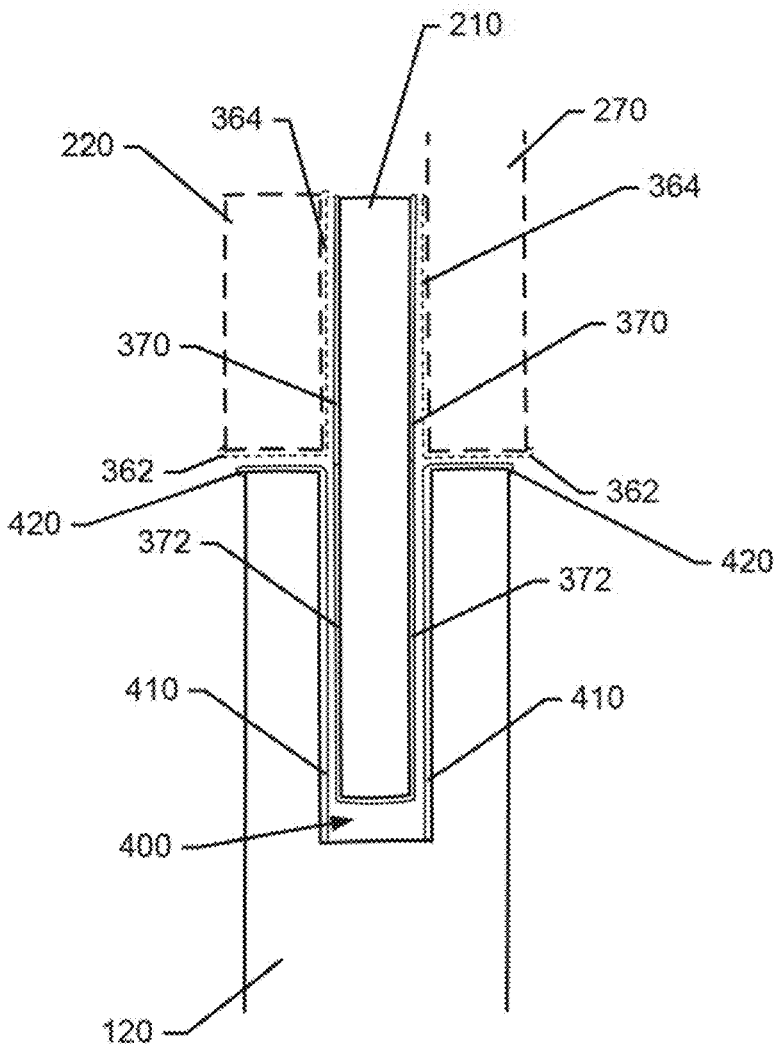
FIG. 6 is a cross section view of side plates that form a guide bar along with a center drive link in accordance with an example embodiment.

Meanwhile, the wear context of the base portion 280 is different in that the base portion 280 contacts the guide bar 120 at a bottom face of the base portion 280, and the base portion 280 contacts two adjacent ones of the center drive links 210 at an inside face thereof. These metal-on-metal sliding or pivoting interactions may introduce wear, and can also introduce corrosion risks. Accordingly, coating material with improved friction and corrosion properties may be advantageous in these areas. Moreover, the coating material may be applied as layers that are applied singly or in combination in areas with different wear contexts as shown in FIGS. 4-6.

Referring first to FIG. 4, a front view of the cutter link 240 is shown. A first coating material 350 may deposited or formed as a thin layer of material (e.g., about 50 microns in depth) coated onto the top face 316 of the top plate 310. Although not required, the first coating material 350 may also be applied or formed onto the outside face 305 of the side plate 300 (as well as the leading edges of the top and side plates 310 and 300). A second coating material 352 may be applied or formed onto the bottom face 314 of the top plate 310 as well. Although not required, the second coating material 352 may also be applied or formed to the inside face 304 of the side plate 300 (or at least a portion thereof). In some embodiments, the first and second coating materials 350 and 352 may be the same or different materials. Moreover, the first and second coating materials 350 and 352 may be selected to have a high hardness with good wear properties. For example, the first and second coating materials 350 and 352 may have a hardness of 1300 Hv or higher. In some cases, the first and second coating materials 350 and 352 may also have corrosion resistive properties. Thus, the first and second coating materials 350 and 352 may be applied as a coating layer that has a combination of mechanical and corrosive wear resistance properties to the cutting edges of the cutter link 240 and surfaces around the cutting edges.

In some embodiments, the first and second coating materials 350 and 352 could alternatively be provided as a material with intermediate hardness. For example, the bulk material (e.g., steel) forming the structures at which the first and second coating materials 350 and 352 are applied or formed may be laser hardened, heat treated, induction hardened, or diffused with materials of intermediate hardness to provide improved adhesion and improved wear properties for the first and second coating materials 350 and 352. Thus, it should be appreciated that any of the coating materials described herein may be provided by adding or applying material on top of the bulk material in one or more layers, or may be provided by treating outer portions (or layers) of the bulk material to form the corresponding coating materials. Combinations of such processes may also be used to form the coating materials. Thus, any coating material described herein could applied over the top of existing base or bulk material, could be formed by treating (e.g., through laser hardening, heat treating, induction hardening, or diffusion) outer layers of the base or bulk material, or may be formed by applying material over the top of existing base or bulk material and treating the applied material, or any other combination thereof.

Other portions of the cutter link 240 may also or alternatively have layers of coating material provided thereon. For example, the depth gauge portion 260 may contact the medium being cut, and thus a top surface of the depth gauge portion 260 may have a third coating material 360 deposited or formed thereon. The third coating material 360 may, for example, be the material with intermediate hardness based on the wear context of the depth gauge portion 260. As shown in FIG. 4, the third coating material 360 could be applied to the top surface of the depth gauge portion 260, and/or to one or both side portions of the depth gauge portion 260. In cases in which the depth gauge portion 260 is desirably designed to experience some wear to achieve a consistent cutting depth as the top plate 310 wears, perhaps only the side portions of the depth gauge portion 260 may be hardened. Moreover, in some cases only one side of the depth gauge portion 260 may be hardened to resist wear from contact with the material being cut. Furthermore, formation of coating materials can be performed all in one step (as is the case when applying a coating layer that has the desired properties over bulk material), or in multiple steps (e.g., treating an outer layer of bulk material, applying a material over the bulk material, and then treating the applied material).

Still other portions of the cutter link 240 may have a different wear context. For example, the bottom surface (or portions thereof) of the base portion 280 of the cutter link 240 may slidably engage or contact the guide bar 120. Meanwhile, the inside surface of the base portion 280 may slidably engage or contact the center drive link 210. For these surfaces, a low friction coating may be more important than hardness. Thus, for example, a fourth coating material 362 may be provided on the bottom surface of the base portion 280 and/or a fifth coating material 364 may be provided on the inside surface of the base portion 280. In some embodiments, the fourth and fifth coating materials 362 and 364 may be the same or different materials. Moreover, the fourth and fifth coating materials 362 and 364 may be selected to have wear resistance, low friction and/or good oil retention properties. For example, the fourth and fifth coating materials 362 and 364 may have porous metallic alloys provided therein (e.g., via powder metallurgy) so that tiny pores in the metal can be vacuum impregnated or otherwise provided with oil to improve friction reduction and oil retention properties for the material. Oilite is one example of such material, but others could be employed in alternative embodiments. Thus, the fourth and fifth coating materials 362 and 364 may be applied as a coating layer that has a combination of wear resistance, low friction and oil retention properties to the inner and bottom surfaces of the cutter link 240 to reduce the amount of oil needed to be applied to lubricate the cutting chain 200.

A side view of the center drive link 210 of an example embodiment is shown in FIG. 5. As shown in FIG. 5, the center drive link 210 may have a sixth coating material 370 disposed or formed at a top portion of the center drive link 210 (where frictional contact with cutter links 270 and side links 220 may occur) and a seventh coating material 372 disposed or formed at a bottom portion of the center drive link 210 (where frictional contact with inside portions of the channel formed in the guide bar 120 may occur). In some embodiments, the sixth and seventh coating materials 370 and 372 may be the same or different materials. Moreover, the sixth and seventh coating materials 370 and 372 may be selected to have low friction and/or good oil retention properties, as described above. Thus, for example, the sixth and seventh coating materials 370 and 372 may also have porous metallic alloys provided therein to improve friction reduction and oil retention properties for the material. Thus, the sixth and seventh coating materials 370 and 372 may be applied as a coating layer that has a combination of low friction and oil retention properties to the side and bottom surfaces of the center drive link 210 to reduce the amount of oil needed to be applied to lubricate the cutting chain 200.

In some cases, coating materials described above may be combined or mixed to improve the properties in more than one respect. For example, any or all of the coating materials described above may include a mixture of porous materials (for oil retention and low friction), hard particles (for improved hardness), and/or corrosion resistant particles (for reducing corrosion. Thus, although certain areas may have specific coatings due to the specific wear context of the corresponding areas, it is also possible to use a multi-purpose coating that improves wear, friction, corrosion resistance and/or oil retention characteristics, although perhaps not maximizing any particular characteristic. Moreover, any or all of the coating materials described above could be employed individually, or in any combination with each other. However, generally speaking, where coating materials are employed, the properties of the coating materials are selected to fit the wear context of the area (on the guide bar 120 or on the chain 200) at which the corresponding coating material will be employed.

It is also possible to apply or form coatings similar to those described above to various portions of the guide bar 120 or components that interact with the chain 200 and/or guide bar 120. For example, as shown in FIG. 6, which illustrates a cross section view (not necessarily to scale since gap sizes and other features may be exaggerated to provide clarity) of a portion of the guide bar 120 at which one of the center drive links 210 is positioned, outer edges and portions of the channel formed in the guide bar 120 may be coated as well. FIG. 6 shows the sixth and seventh coating materials 370 and 372 on each opposing side of the center drive link 210. Moreover, FIG. 6 further shows an instance of the side link 220 and cutter link 240 where they interface with the center drive link 210. Thus, the correlation or interface between the sixth coating material 370 of the center drive link 210 with the fifth coating material 364 of the inside of the cutter link 240 (and side link 220) can be appreciated.

Similar correlation between coating materials on chain links and portions of the guide bar 120 may also be included, as shown in FIG. 6. In this regard, the guide bar 120 may form a channel 400 inside which the center drive link 210 is transported as the chain 200 rotates around the guide bar 120 (as described above in reference to FIG. 2). The channel 400 may be formed between peripheral edges of side plates that are joined (directly or indirectly) to form the guide bar 120. Interior sidewalls of the channel 400 (and perhaps also the bottom of the channel 400 in some cases) may be coated with eighth coating material 410. The eighth coating material 410 may potentially interface with the seventh coating material 372 that is disposed on the bottom portion of the center drive link 210. Meanwhile, a ninth coating material 420 may be provided on the peripheral edges of the guide bar 120 to interface with the fourth coating material 362 provided on the bottom of the side link 220 and the base portion 280 of the cutter link 240.

The eighth and ninth coating materials 400 and 410 may be the same or different materials. Moreover, the eighth and ninth coating materials 400 and 410 may be selected to have low friction and/or good oil retention properties, as described above. Thus, for example, the eighth and ninth coating materials 400 and 410 may also have porous metallic alloys provided therein to improve friction reduction and oil retention properties for the material. Thus, the eighth and ninth coating materials 400 and 410 may be applied as a coating layer that has a combination of low friction and oil retention properties to the sidewalls of the channel 400 and to peripheral edges of the guide bar 120 to reduce the amount of oil needed to be applied to lubricate the cutting chain 200. Similar to the descriptions above, the coating materials properties described above may be mixed also in connection with defining layers of materials to deposit or otherwise form on the guide bar 120. Thus, for example, a mixture of porous materials (for oil retention and low friction), hard particles (for improved hardness), and/or corrosion resistant particles (for reducing corrosion) may also be included in the eighth and ninth coating materials 400 and 410 for application to the guide bar 120.

Surfaces of the guide bar 120 that interface with a nose wheel, hub, hub wheel/rings, etc., may also be coated with any of the materials described above. Thus, for example, internal surfaces of the guide bar proximate to the components listed above maybe coated in the manner described above. In such situations, the wear context for the corresponding component may determine which specific coating to employ. Alternatively, mixtures of coating materials may be employed as described above.

Based on the descriptions above, it should be appreciated that some example embodiments may include a chain or a chainsaw with coating materials selected based on wear context. For example, the cutting chain may include a plurality of drive links, and a plurality of cutter links. Each of the drive links includes a top portion and a bottom portion that interfaces with a guide bar of the chainsaw. The cutter links are operably coupled to respective ones of the drive links at the top portion thereof. At least one of the cutter links includes a base portion and a cutting portion extending away from the base portion. The cutting portion includes a side plate and a top plate, the top plate including a top face and a bottom face. The side plate includes an outer face and an inside face. Multiple coating materials are provided on respective different surfaces of the drive links or cutter links such that different coating materials are applied based on a wear context of the respective different surfaces. In other words, each of multiple surfaces may have a respective coating material applied thereon. The coating materials can be the same or different, and have properties that correspond to the wear context of the corresponding surface.

In an example embodiment, the multiple coating materials may include a first coating material provided at the top face of the top plate and a second coating material provided at the bottom face of the top plate. Additionally or alternatively, the second coating material may be further provided at the inside face of the side plate. Additionally or alternatively, the first and second coating materials may have a hardness of 1300 Hv or higher. Additionally or alternatively, a top surface of a depth gauge portion of the cutter link may be provided with a third coating material thereon. In some cases, any or all of the features described above may be employed (individually or in combination) and an inside surface of the base portion slidably engages the drive link. In such an example, a fourth coating material may be provided on a bottom surface of the base portion and a fifth coating material is provided on the inside surface of the base portion. In some cases, any or all of the features described above may be employed (individually or in combination) and a sixth coating material may be provided at the top portion of the drive link and a seventh coating material may be provided at the bottom portion of the drive link. In some cases, any or all of the features described above may be employed (individually or in combination) and an eighth coating material may be provided at an interior sidewall of a channel of the guide bar to interface with the seventh coating material, and a ninth coating material may be provided on a peripheral edge of the guide bar to interface with the fourth coating material provided on the bottom surface of the base portion of the cutter link. In some cases, any or all of the features described above may be employed (individually or in combination) and respective ones of the multiple coating materials may include porous materials for oil retention and low friction, hard particles for improved hardness, or corrosion resistant particles for reducing corrosion. Alternatively, multiple ones of the multiple coating materials may include a mixture of porous materials for oil retention and low friction, hard particles for improved hardness, and corrosion resistant particles for reducing corrosion.

Figure 7:
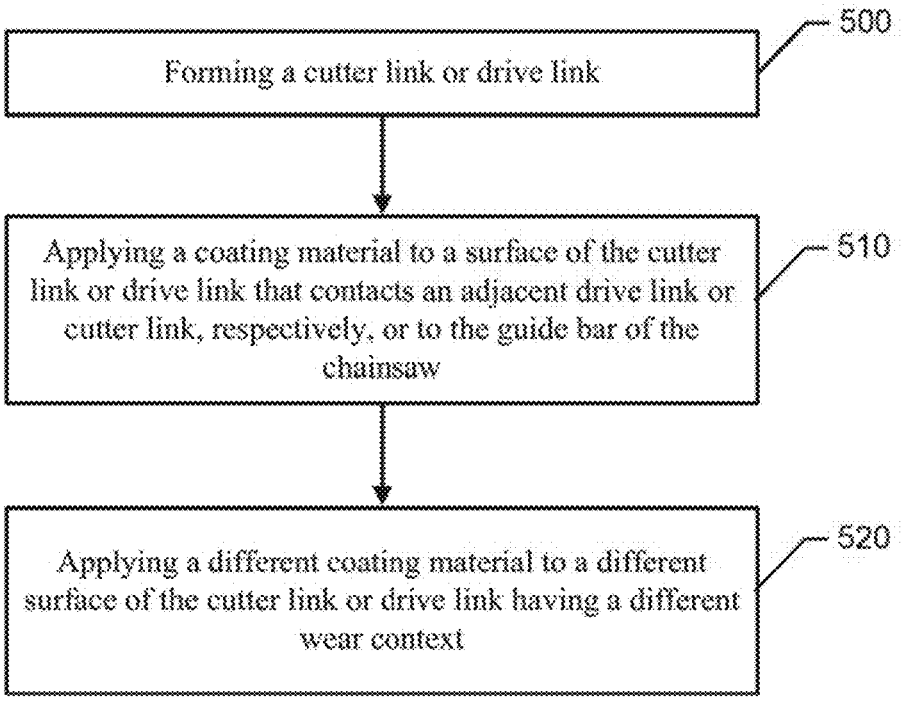
FIG. 7 illustrates a block diagram of a method of modifying a cutting chain in accordance with an example embodiment.

FIG. 7 illustrates a block diagram of a method of modifying a cutting chain for a chainsaw. The method may include forming a cutter link or drive link at operation 500. The method may further include applying a coating material to a surface of the cutter link or drive link that contacts an adjacent drive link or cutter link, respectively, or to the guide bar of the chainsaw at operation 410, and applying a different coating material to a different surface of the cutter link or drive link having a different wear context at operation 420. The coating material and the different coating material each have properties selected based on the corresponding wear context of the surface on which they are provided.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A cutting chain for a chainsaw, the chain comprising:

a plurality of drive links, each of the drive links including a top portion and a bottom portion that interfaces with a guide bar of the chainsaw; and a plurality of cutter links operably coupled to respective ones of the drive links at the top portion thereof, wherein at least one of the cutter links comprises:

a cutting portion comprising a side plate and a top plate, the top plate including a top face and a bottom face, the side plate including an outer face and an inside face; and a base portion comprising an upper portion adjacent the side plate, a middle portion, and a lower portion extending below apertures disposed in the at least one of the cutter links;

wherein a top face cutting portion coating having a hardness of greater than or equal to 1300 Hv is disposed on the top face of the top plate of the cutting portion of the at least one of the cutter links and a lower base portion coating, different than the top face cutting portion coating, having low friction properties is disposed on the lower portion of the base portion and extends in a direction toward the middle portion of the at least one of the cutter links.

2. The cutting chain of claim 1, wherein the at least one of the cutter links further comprises a depth gauge portion on the upper portion of the base portion, wherein a depth gauge coating is disposed on the depth gauge portion.

3. The cutting chain of claim 1, wherein an outer side plate coating is further provided on the outside face of the side plate.

4. The cutting chain of claim 1, wherein an inside surface of the base portion slidably engages the drive link.

5. The cutting chain of claim 4, wherein a top drive link coating is provided at the top portion of the drive link and a bottom drive link coating is provided at the bottom portion of the drive link.

6. The cutting chain of claim 1, wherein a bottom face cutting portion coating is disposed on the bottom face of the top plate of the cutting portion.

7. A cutting chain for a chainsaw, the chain comprising:

a plurality of drive links, each of the drive links including a top portion and a bottom portion that interfaces with the guide bar of the chainsaw; and a plurality of cutter links operably coupled to respective ones of the drive links at the top portion thereof, wherein at least one of the cutter links comprises:

a cutting portion including a side plate and a top plate, the top plate including a top face and a bottom face, the side plate including an outer face and an inside face; and a base portion comprising an upper portion adjacent the side plate, a middle portion, and a lower portion extending below apertures disposed in the at least one of the cutter links;

wherein a top face cutting portion coating having a hardness of greater than or equal to 1300 Hv is disposed on the top face of the top plate of the cutting portion of the at least one of the cutter links and a lower base portion coating, different than the top face cutting portion coating, having low friction properties is disposed on the lower portion of the base portion of the cutting portion of the at least one of the cutter links.

8. The cutting chain of claim 7, wherein the at least one of the cutter links further comprises a depth gauge portion on the upper portion of the base portion, wherein a depth gauge coating is disposed on the depth gauge portion.

9. The cutting chain of claim 7, wherein an outer side plate coating is further provided on the outside face of the side plate.

10. The cutting chain of claim 7, wherein an inside surface of the base portion slidably engages the drive link.

11. The cutting chain of claim 10, wherein a top drive link coating is provided at the top portion of the drive link and a bottom drive link coating is provided at the bottom portion of the drive link.

12. The cutting chain of claim 7, wherein a bottom face cutting portion coating is disposed on the bottom face of the top plate of the cutting portion.

13. A cutting chain for a chainsaw, the chain comprising:

a plurality of drive links, each of the drive links including a top portion and a bottom portion that interfaces with a guide bar of the chainsaw; and a plurality of cutter links operably coupled to respective ones of the drive links at the top portion thereof, wherein at least one of the cutter links comprises:

a cutting portion comprising a side plate and a top plate, the top plate including a top face and a bottom face, the side plate including an outer face and an inside face; and a base portion comprising an upper portion adjacent the side plate, a middle portion, and a lower portion extending below apertures disposed in the cutter link;

wherein a top face cutting portion coating having a hardness of greater than or equal to 1300 Hv is disposed on the top face of the top plate of the cutting portion of the at least one of the cutter links and an upper base portion coating, different than a top face cutting portion, having low friction properties is disposed on the upper portion of the base portion of the at least one of the cutter links.

* * * * *